US007714720B2

(12) United States Patent
Hietanen et al.

(10) Patent No.: US 7,714,720 B2
(45) Date of Patent: May 11, 2010

(54) ALARM SYSTEM AND ALARM DEVICE

(75) Inventors: Heikki Hietanen, Espoo (FI); Mikael Westerlund, Espoo (FI)

(73) Assignee: Savox Communications Oy AB (Ltd), Espoo (FI)

( * ) Notice: Subject to any disclaimer, the term of this patent is extended or adjusted under 35 U.S.C. 154(b) by 235 days.

(21) Appl. No.: 11/916,668

(22) PCT Filed: Jun. 6, 2006

(86) PCT No.: PCT/FI2006/000180

§ 371 (c)(1),
(2), (4) Date: Dec. 6, 2007

(87) PCT Pub. No.: WO2006/131590

PCT Pub. Date: Dec. 14, 2006

(65) Prior Publication Data

US 2008/0204231 A1 Aug. 28, 2008

(30) Foreign Application Priority Data

Jun. 6, 2005 (FI) ..... 20050597

(51) Int. Cl.
*G08B 13/14* (2006.01)

(52) U.S. Cl. ..... 340/568.1; 340/539.26; 340/5.1; 224/243

(58) Field of Classification Search ..... 340/568.1, 340/5.1, 5.2, 5.33, 539.26, 825.36, 328, 540, 340/571, 574; 224/244, 243
See application file for complete search history.

(56) References Cited

U.S. PATENT DOCUMENTS 3,530,451 A 9/1970 Devine
5,479,149 A 12/1995 Pike
5,589,818 A 12/1996 Queen
5,598,151 A * 1/1997 Torii, Jr. ..... 340/5.33

(Continued)

FOREIGN PATENT DOCUMENTS

WO 2005/010843 A1 2/2005

OTHER PUBLICATIONS

Sep. 6, 2006 International Search Report included in Published PCT Application Serial No. PCT/FI06/000180.

(Continued)

*Primary Examiner*—Toan N Pham
(74) *Attorney, Agent, or Firm*—Young & Thompson

(57) ABSTRACT

An alarm system includes a detector arranged in connection with a holster for carrying a force instrument, the detector detecting, if the force instrument is removed from the holster; information on the situation is produced on the basis of the identification and relayed to the user's control room so that a message is relayed to the communication unit of the user of the force instrument, the communication unit relaying the message further to the control room via a base station. The detector is adapted to detect the existence of the force instrument in the holster, its missing from or its movement out of or into the holster. A detector-cpu is adapted to receive a signal or message from the detector and forms at least part of the contents of the message on the basis of the signal or message, the detector-cpu being adapted to control the communication unit to transmit the message.

20 Claims, 2 Drawing Sheets

U.S. PATENT DOCUMENTS

| | | | | |
|---|---|---|---|---|
| 5,779,114 | A * | 7/1998 | Owens | 224/193 |
| 5,828,301 | A | 10/1998 | Sanchez et al. | |
| 6,043,644 | A | 3/2000 | De Coulon et al. | |
| 6,281,792 | B1 * | 8/2001 | Lerg et al. | 340/540 |
| 6,533,149 | B2 * | 3/2003 | Vor Keller et al. | 224/244 |
| 6,568,116 | B2 * | 5/2003 | Hathaway | 42/70.11 |
| 6,588,635 | B2 * | 7/2003 | Vor Keller et al. | 224/244 |
| 6,641,009 | B2 * | 11/2003 | French et al. | 224/244 |
| 7,096,619 | B2 * | 8/2006 | Jackson et al. | 42/70.11 |
| 7,525,568 | B2 * | 4/2009 | Raghunath | 348/61 |
| 2002/0153396 | A1 | 10/2002 | French et al. | |

OTHER PUBLICATIONS

Nov. 24, 2005 Search Report in corresponding Finnish Application Serial No. 20050597.
European Office Action dated Apr. 3, 2009.

* cited by examiner

ALARM SYSTEM AND ALARM DEVICE

The present invention relates to an alarm system, which is provided with a detector for detecting a force instrument, the associated detector with a holster intended for carrying a force instrument the detector detecting if the force instrument is removed from the holster, information on the situation is produced on the basis of the said identification and relayed to the user's control room.

The invention also relates to an alarm device, which is suitable to be used as part of the alarm system according to the invention.

BACKGROUND OF THE INVENTION

Different kinds of instruments, by means of which it is possible to respond to different kinds of situations requiring the use of force, are part of the equipment of the police, board guards and other similar authorities. Of these instruments generally belonging to the equipment, a hand gun, a pistol, or a similar weapon can be classified as a deadly force instrument. Respectively, a pepper spray, a tear gas spray, an electric paralyzer or a similar device can be classified as a non-deadly force instrument. In connection with this invention, the common name force instrument will be used of the instruments in either of the above-mentioned groups. The operation of a single authority is generally lead, controlled and assisted by a control room, a direction centre, a command centre, an alarm centre, or similar. In connection with this invention, the term control room will be used of these.

It is common for the situations, in which these force instruments are used that they are generally needed in unexpected situations with an evident danger or threat of violence. The opposing party may suddenly attack an authority carrying out his work, or the threat of such a situation comes to a head suddenly and unexpectedly. The objective in the operation of authorities is that no single authority should face the threat or danger of violence in any situation without having sufficient back-up groups to assist and make sure a safe work performance or situation. For communicating information on this situation to and for receiving instructions from the control room, the equipment of an individual authority also includes a means of communication, which can transmit and receive information and which can be, for example, a radiophone or a similar terminal device; preferably, for example, a tetra terminal to be used in an authority network.

In practice, when a situation arises in the work of an authority that the possibility of the use of a force instrument arises or exists, the control room needs the information on this situation. One option to act is that the authority informs of the changed situation, for example, orally, by using his means of communication. However, in such a situation the authority also has many other tasks to perform so that the use of a means of communication in very fast situations is somewhat difficult even if it had functions facilitating fast use, such as speech activation or similar properties.

DESCRIPTION OF THE RELATED ART

The patent specification U.S. Pat. No. 3,530,451 discloses an electronic alarm system, which is connected to a weapon holster worn on the body. The invention includes an instrument for identifying the removal of the weapon from the holster and for activating a radio transmitter. A remote receiving station is provided with a radio receiver so that a situation of danger will be identified on the basis of the received signal. The transmission of the signal can also be activated by a manual switch or by removing the holster from the body. Here the transmitting radio transmitter in question can be identified on the basis of the tone of the radio signal.

The patent specification U.S. Pat. No. 5,479,149 discloses a system for monitoring and recording the use of the weapon of an authority. A receiver/recorder/transmitter carried by an authority is activated by removing the weapon from its holster or by a manual switch. This activation causes the information on the removal of the weapon from the holster to be transmitted and, after this all sounds in the vicinity of the authority are transmitted and recorded. Further, it is proposed in this specification that the transmission will be received and recorded to a receiver in a patrol car. From the patrol car, the transmission can be transmitted further to a transmission station, where it will be recorded and the supervisor will get an audio and/or visual alarm, all recorded information, information on the authority in question, and date and time for later use. On the basis of this information, the supervisor can send back-up forces to the authority acting in the situation, when needed. The system can also be provided with a transmitter connected to the weapon, which makes possible the follow-up of the weapon and the defining of its location, if the weapon is separated from the authority.

SUMMARY OF THE INVENTION

For clarity, the term user will be used of the authority, such as persons employed by the police, border guards, and similar authorities or organisations, and of guards or other similar users of the invention.

The object of the invention is to further develop and improve the state-of-the-art solutions and to offer a system, which is reliable, simple, functionally safe and serving versatile use. One object of the invention is to achieve a system, by means of which very versatile information can be immediately formed on a situation of threat or danger and this information can be further transmitted to all parties concerned; for example, first and foremost to the user's control room but secondly, according to choice, to other users in the same organisation present/operating in the vicinity of the user in question. An object is also to obtain classified information on the situation in progress, on the basis of which correct conclusions can be drawn, among other things, concerning additional assistance or back-up. On the basis of the said classified information it is also possible to assess how the situation is going to progress so that it will be easier for the persons in control of the situation to take correct actions.

The alarm system of the invention is characterised in that the message will be relayed to the means of communication of the user of the force instrument, which will further transmit the message via a base station to the control room.

The alarm device of the invention is again characterised in that it has:

- a detector fitted into the holster or in a connection with the holster of a force instrument, the detector being adapted to detect if the force instrument is in place, if it is missing, or if it is being removed from or put into the holster;
- a detector-cpu adapted to receive a signal or message from the detector, the detector-cpu being adapted to form, on the basis of the signal or message, at least part of the contents of the message, and to control the means of communication for transmitting the message.

According to an advantageous embodiment of the invention, the system includes a detector-cpu, which receives the signal or message produced by the detector, and which forms a message and/or control command that the means of communications will understand. Thus, the detector-cpu works as the "brains" of the system, receiving data, processing and modifying it further and control the means of communications to perform the necessary further transmission of the data. Preferably, the detector-cpu is programmable and/or configurable in a desired way. In this case, a task-specific, user-specific or user group-specific message can be programmed as an alarm message, which can be automatically transmitted to a predetermined address, such as the control room.

One special application of the alarm system is police use. When a force instrument, such as a pistol, is removed from the holster, the situation is generally extremely threatening and there is not necessarily enough time to send a spoken message by radio to request back-up. However, the need for further assistance is often essential or, at the least, information on the situation must be sent further, in which case the purpose of the application is to automatically transmit a message of the need of further assistance to the control room, when the force instrument is removed from the holster. With the system according to the invention, the message can be transmitted to be used by the control room in an exact format, and it is possible to form exact information on the situation, including, when so desired, the information: who, what, where, when, in which situation, how the situation is developing, etc.

BRIEF DESCRIPTION OF THE DRAWINGS

The invention will next be explained in more detail, referring to the enclosed drawings, in which.

DETAILED DESCRIPTION OF THE PREFERRED EMBODIMENTS

Figure 1:
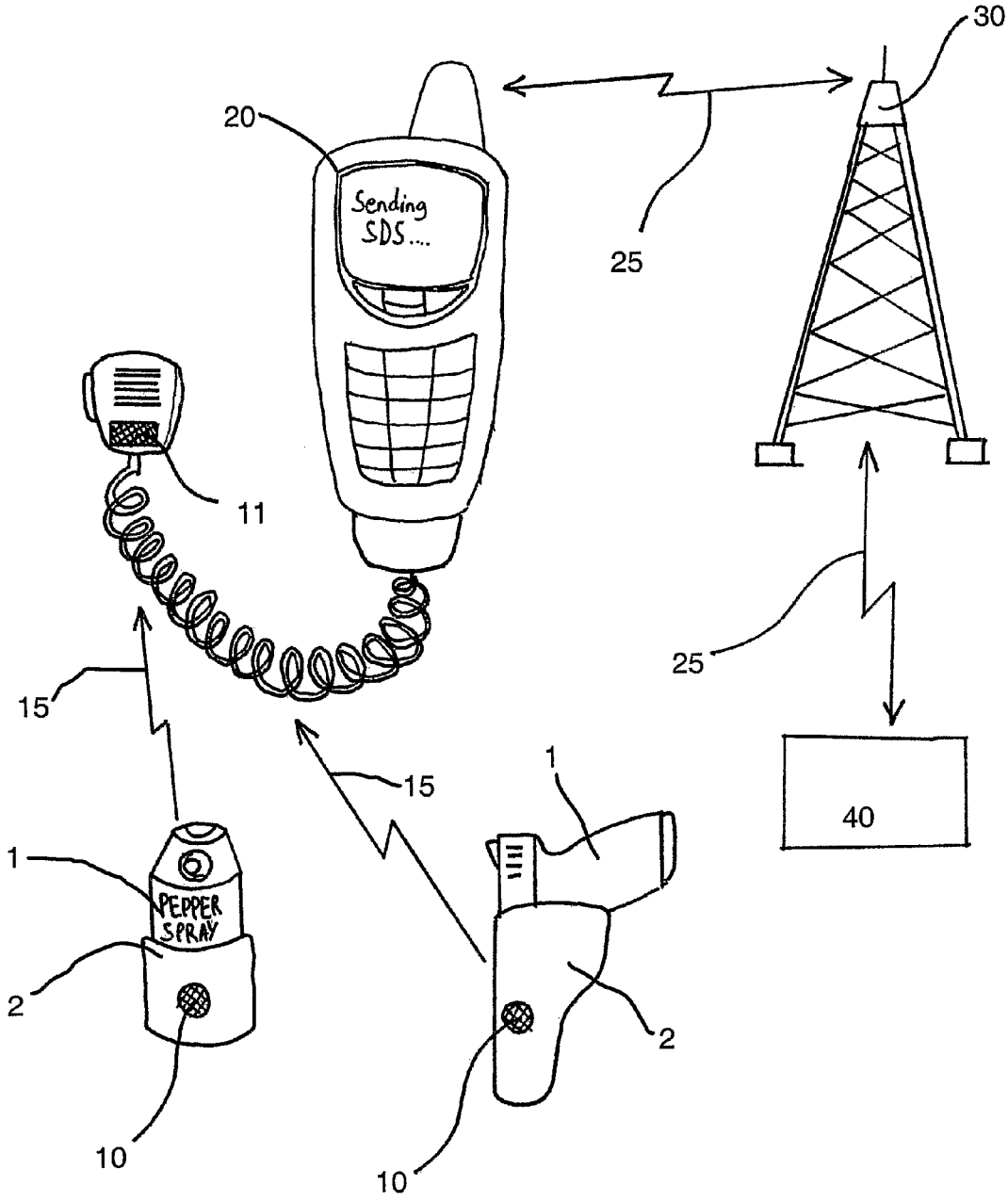
FIG. 1 represents the alarm system.

The operation of the system will next be explained by way of an example, referring to the enclosed FIG. 1. A user, such as a policeman, suddenly faces a threatening situation and needs a force instrument 1, such as his hand gun. The user draws his hand gun 1 from its holster 2, and a detector 10 detects this. The detector 10 transmits a message 15 to a detector-cpu 11, which is located in an auxiliary device, such as a monophone, connected to the user's means of communication 20. The detector-cpu 11 forms a text-form message 25 from the message 15 and the identification data of the means of communication 20, and controls the means of communication 20, i.e. in this example the Tetra terminal device, to transmit this as a SDS message 25 via a base station 30 to the control room 40. On the basis of the SDS message 25, the control room 40 knows that the message 25 has been received from the terminal device 20, the ID of which is XXXXXXXXX (in which case the user is N.N.) and that the force instrument 1 has been removed from the holster 2. After receiving the information, the control room may draw its own conclusions of the situation and decide on the possible sending of additional assistance. As the situation progresses further, the user makes a decision that the force instrument 1, the hand gun, first taken into use is overreacting to the situation and returns it to its holster 2, in which case the system can transmit a new message 25 concerning the changed situation to the control room 40. However, the user may, for example, remove a gas spray 1 from its holster 2, in which case a new message 25 will be transmitted to the control room 40. Within such a short period of time, the control room 40 will thus have access to the information that the user has been in a threatening situation, in which the first reaction caused the removal of a deadly force instrument 1 from the holster, but after the situation or an assessment of the situation was specified further, the deadly force instrument 1 was returned to the holster 2 and only a non-deadly force instrument 1 may possibly be needed to clear the situation. When needed, the control room 40 can ask the terminal device, i.e. the means of communication 20 for positioning information, i.e. coordinates, unless the system has been adapted to transmit this positioning data by default as part of the message 25. Similarly, according to an advantageous additional feature, also information on the task in progress will be sent as part of the message 25; for example, the user is performing the task XYZ.

The detector 10 is fitted in the holster 2 of the force instrument 1 or in a connection with the holster 2 so that it will detect the existence of the force instrument 1 in the holster, if the instrument is missing or if it is moved out of or into the holster 2. The operating principle of the detector can be, for example, inductive, capacitive, resistive, mechanical or optical. For example, if the operating principle is inductive, as the force instrument 1 is in the holster, the total inductance of the detector 10 measured from the coil is bigger than without the force instrument 1. The force instrument can be read, for example, at intervals of 0.5 . . . 1 seconds so that a change in the signal of the detector will be detected immediately or almost immediately. Because the force instruments come in innumerable models and materials, steel, stainless steel, plastic components, etc, and because the measuring values obtained from these are different, detectors 10 based on inductive or capacitive identification are preferable types of detectors. Likewise, holsters for force instruments come in numerous different models so that the fitting of the detector in the holster is easier if the detector is chosen so that its physical dimensions are relatively small. When needed, for example, a sticker or some other corresponding surface can be fastened to the force instrument to facilitate the reading of the detector and for improving the reliability of the reading, the detector being able to measure or read the necessary physical value from this surface.

The detector-cpu 11 receives the signal or message 15 produced by the detector 10. Here, the signal refers to a value or change in a value of a physically measurable quantity, such as a change in voltage, inductance, capacitance, resistance, or similar, and the message 15 refers to similar, but it can be interpreted to contain information, which can be presented in an analogue or digital format. For example, the message 15 can be of the so-called "proprietor" type, which can be determined fully according to the device in question. After obtaining the signal or message 15, the detector-cpu 11 forms or builds or generates a message understood by the terminal device, i.e. the means of communication 20, such as a message concerning an auxiliary device and/or a control command for transmitting the message further. An example of such an embodiment is the means of communication 20, which is a tetra terminal, supporting the SDS message of the auxiliary device. According to an advantageous embodiment, the detector-cpu 11 controls the terminal device, i.e. means of communication 20 to transmit the message 25 further to the base station 30. The detector-cpu 11 can be, for example, a physical device containing both electronic components and a program, or it can be a purely programmatic device, in which case the detector-cpu 11 can be, for example, a program to be loaded into the means of communication 20 or to an auxiliary device of the means of communication. By means of programmability and/or configurability, it is, for example, possible to program the criteria for the activation of an alarm in a user-specific manner, a delay can be programmed to the trigger function of the alarm, or the alarm can be cancelled before it has been transmitted further by radio.

FIGS. 2*a*-2*f* represent different options for configuring the detector 10, the detector-cpu 11, and the means of communication 20.

Figure 2A:
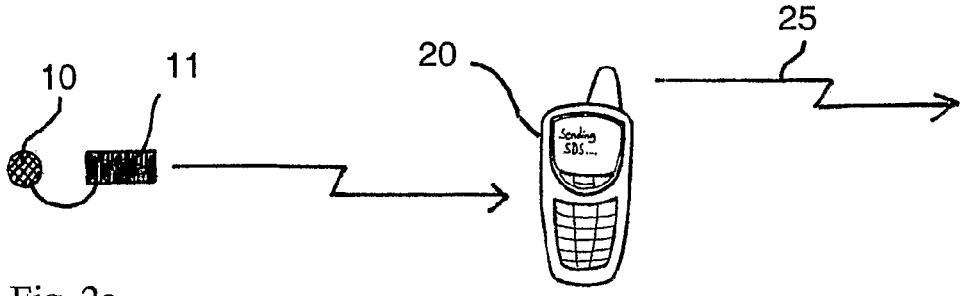
FIGS. 2*a*-2*f* represent different embodiment alternatives for configuring components of the system from the detector 10 to the transmission of the message 25.

In FIG. 2*a*, the detector 10 and the detector-cpu 11 are connected to each other by means of a wire so that the signal of the detector will be lead directly to the detector-cpu 11, which forms at least part of the message 25 and controls the means of communication 20 to transmit the message 25 further.

Figure 2B:
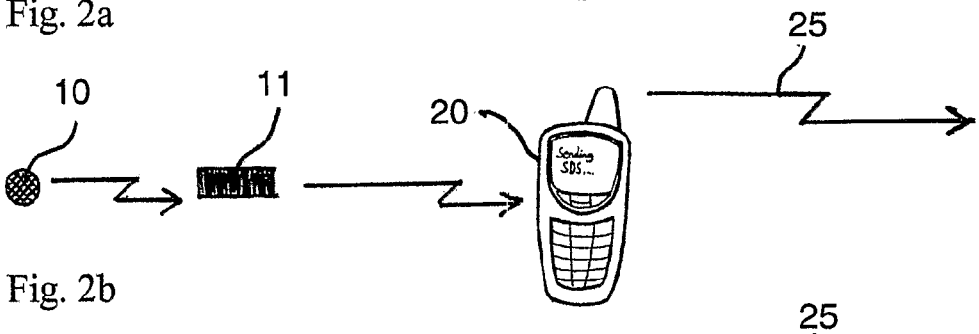

In FIG. 2*b*, the detector 10, the detector-cpu 11, and the means of communication 20 are all separate devices, and they are connected to each other wirelessly, for example, by way of a radio. The detector 10 transmits the signal via radio to the detector-cpu 11, which again forms part of the message and controls the means of communication 20 to transmit the message 25 further.

Figure 2C:
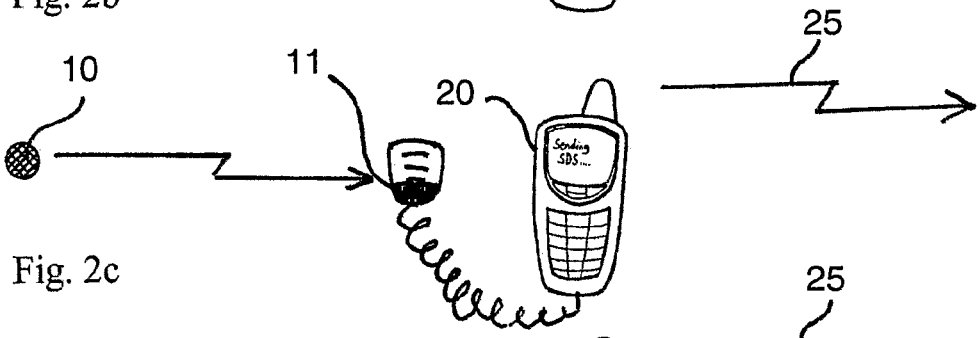

In FIG. 2*c*, the detector-cpu 11 is located, for example, to a separate monophone, headset, transmission button or a similar auxiliary device of the means of communication 20. In this case, the detector-cpu can control the means of communication 20 and the transmission of the message 25 directly through contact pins of the connector for the auxiliary device.

Figure 2D:
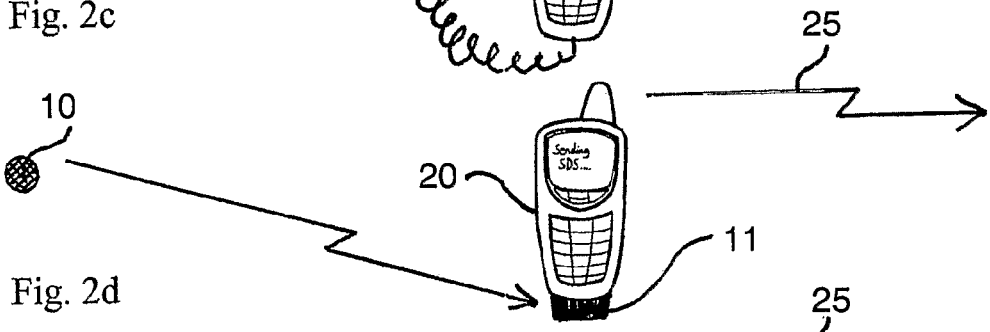

In FIG. 2*d*, the detector-cpu 11 is arranged to the connector for the auxiliary device connected to the means of communication 20. The detector 10 transmits a signal by way of radio to the detector-cpu, which control the means of communication through the contact pins of the connector for the auxiliary device, similarly to the arrangement in FIG. 2*c*.

Figure 2E:
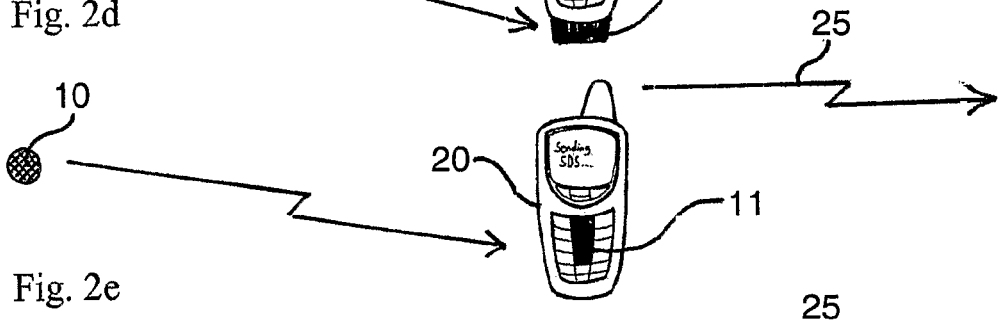

In FIG. 2*e*, the detector-cpu 11 is integrated to the means of communication 20. In this case, the means of communication thus understands directly the signal transmitted by the detector 10, processes the message 25 and transmits it to the base station.

Figure 2F:
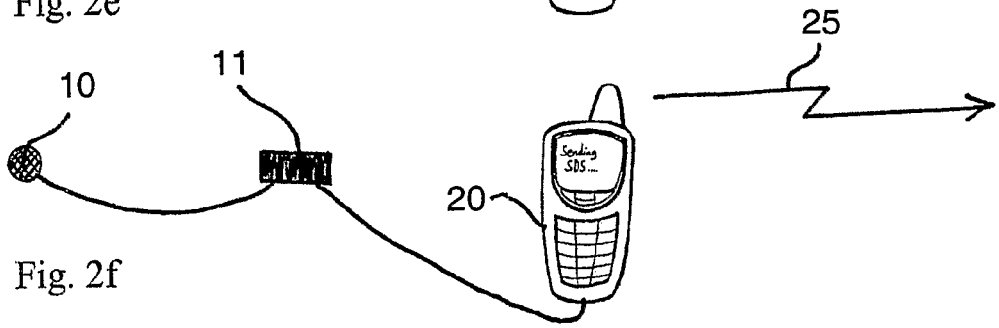

In FIG. 2*f*, the detector 10, the detector-cpu 11, and the means of communication 20 are all connected to each other by means of a wire.

As can be seen from FIGS. 2*a*-2*f*, there are several options. Advantageously, a message 15 from a detector 10 to a detector-cpu 11 is transmitted by radio as a signal with radio frequency, but also a message to be relayed along a wire is possible. Technically, there is no great difference between these options. It is mainly a question of the comfort of the user and, to some extent, of the reliability of the system; a big number of devices connected to each other with wires, especially when the user does physical work, exposes the system to a disconnection of a wire contact and thus to a failure in the system. Likewise, the available devices, especially the properties of the means of communication 20 affect the recommendable configuration. An example of an affecting property is the possibility or ability of the means of communication 20 to receive a message of an auxiliary device or a control command by radio or only through the contact pins of a connector for the auxiliary device.

The means of communication 20 of the user typically functions, for example, in an authority network in use in each country, in which case the invention will make use of the properties of this data communications network. One property of the network is to transmit the message 25 from a terminal device, i.e. the means of communication 20 to a base station 30, from which the message will be relayed further to the desired target, such as the control room 40. Examples of such data communication networks suitable for this purpose and types of messages 25 used in these are, for example, SDS messages to be relayed in Tetra networks. It is also possible to transmit a text-format message in the P25 networks, i.e. the digital P25 network in use in the USA. The same principles are also used, for example, in the Tetrapol network. In principle, the minimum contents of the message 25 is "who" and "what", i.e. the message contains at least the identification of the user or some kind of ID information, such as the telephone number of the user's means of communication and information about the removal of the force instrument from its holster. The contents of the message 25 may partly be information 21 formed by the detector-cpu 11, such as "what", and partly information 21 formed by the means of communication 20, such as "who". If the user 5 has several force instruments 1 belonging to different categories, such as a hand gun and a pepper spray, the above-mentioned "what" information specifies also the category or other identification information of the force instrument. In the same way, the date-time information belongs to the basic properties of these messages to be transmitted via the above-mentioned and other similar networks so that upon logging into the log of the control room 40, also this information provides useful data, especially when analysing the situation afterwards.

In addition to the above-mentioned minimum contents, the message 25 can contain a lot of other information. One especially useful piece of information is "where", i.e. the user's current or last known location. This information is advantageously based on the location determined by the GPS positioning device in the user's means of communication 20. GPS or a similar satellite positioning does not function reliably inside, and the removal of the force instrument 1 from its holster may as well occur inside as outside. In this case, the user is either in a blind spot or in a coverage area in relation to the GPS signal. Because of this it is preferable that a part of the system remembers the latest reliable positioning information determined with relatively accuracy, and this information will be stored to be relayed along with the message 25 or as a consequence of it. The positioning information determined by the positioning device can be arranged as a parameter, in which case it will be generated and relayed either immediately with the message 25 or, alternatively, the control room will ask the data from the user's means of communication after having received information on the situation that has arisen.

Advantageous properties of the base station 30 and the network for using the invention are, in addition to the ones mentioned above, among others the possibility of the control room to switch on a so-called "ambient listening" property in the means of communication 20 so that it is possible in the control room to listen to possible conversations or shots in the vicinity of the user, and when needed or desired, to record them.

Other advantageous additional features or properties of the alarm system or alarm device of the invention are, among others, low power consumption so that the operating time would be as long as possible, and a detector on the running out of the battery so that the user knows when to change the battery in order to keep the system operating. The use of the alarm device and alarm system is also facilitated by a switch, with which the device can be switched off for the duration of a break, or if the force instrument, such as a gun is removed from the holster for service, etc.

REFERENCE NUMBERS IN THE FIGURES

1 force instrument
2 holster
5 user
10 detector
11 detector-cpu

15 message (between the detector 10 and the detector-cpu 11)
16 data (formed by the detector-cpu)
20 means of communication
21 data (formed by the means of communication)
25 message (transmitted by the means of communication)
30 base station
40 control room

The invention claimed is:

1. An alarm system, comprising:

a detector (10) connectable with a holster of a force instrument, the detector being adapted to detect a removal of the force instrument from the holster;

a means of communication having am ambient listening property, and a detector-cpu adapted to receive a signal from the detector, the detector-cpu being configured to form at least part of a content of a message on the basis of the signal and to control the means of communication to transmit the message to a control room via a base station, wherein the control room is configured to switch on an ambient listening property of the means of communication so that conversations or shots in the vicinity of the user of the force instrument are listenable.

2. The alarm system according to claim 1, wherein the detector-cpu is programmable and/or configurable.

3. The alarm system according to claim 1, wherein the message contains information that indicates at least one of: "who", "what", "where", "when", "in which situation", and "how the situation progresses".

4. The alarm system according to claim 3, wherein the message contains classification or identification information on the force instrument.

5. The alarm system according to claim 1, wherein the alarm system is configured to make use of the message properties of a data communications network used by the means of communication.

6. The alarm device according to claim 5, wherein the data communications network is any of a Tetra, Tetrapol, and a P25 network.

7. The alarm system according to claim 1, wherein the message is in text format.

8. The alarm device according to claim 7, wherein the text format is an SDS message.

9. The alarm system according to claim 1, wherein the message contains information formed by the detector-cpu and information formed by the means of communication.

10. The alarm device according to claim 1, wherein the control room is further configured to record the conversations or shots.

11. An alarm device, comprising:

a detector connectable with a holster (2) of a force instrument, the detector being adapted to detect a removal of the force instrument from the holster;

means of communication configured to transmit a message to a control room;

a detector-cpu adapted to receive a signal from the detector, the detector-cpu being adapted to form at least part of the contents of the message on the basis of the signal and to control the means of communication to transmit the message; and means for switching, as a response to a command given via a communication network, the means for communications to a listening mode so that conversations or shots in the vicinity of a user of the force instrument are listenable in the control room.

12. The alarm device according to claim 11, wherein the connection between the detector and the detector-cpu wireless.

13. The alarm device according to claim 11, wherein the connection between the detector-cpu and the means of communication is either wired or wireless.

14. The alarm device according to claim 11, wherein the detector-cpu is fitted into one of the following: a separate monophone, a headset, and a transmission button.

15. The alarm device according to claim 11, wherein the force instrument is one of a hand gun, and a pistol.

16. The alarm device according to claim 11, wherein the force instrument one of pepper spray, tear gas spray, and an electrical paralyzer.

17. The alarm device according to claim 11, wherein the detector-cpu is configured to request positioning data from the means of communication.

18. The alarm device according to claim 17, wherein the positioning data comprises GPS coordinates.

19. The alarm device according to claim 11, wherein the detector-cpu is programmable and/or configurable.

20. The alarm device according to claim 11, wherein the control room is further configured to record the conversations or shots.

* * * * *